US009761358B2

(12) United States Patent
Sakuma et al.

(10) Patent No.: US 9,761,358 B2
(45) Date of Patent: Sep. 12, 2017

(54) METHOD FOR PRODUCING RARE EARTH MAGNETS, AND RARE EARTH MAGNETS

(75) Inventors: Noritsugu Sakuma, Susono (JP); Hidefumi Kishimoto, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 14/240,133

(22) PCT Filed: Aug. 22, 2012

(86) PCT No.: PCT/IB2012/001613

§ 371 (c)(1),
(2), (4) Date: Feb. 21, 2014

(87) PCT Pub. No.: WO2013/027109

PCT Pub. Date: Feb. 28, 2013

(65) Prior Publication Data

US 2014/0191833 A1 Jul. 10, 2014

(30) Foreign Application Priority Data

Aug. 23, 2011 (JP) ..... 2011-181715

(51) Int. Cl.
*H01F 1/057* (2006.01)
*C22C 38/00* (2006.01)
(Continued)

(52) U.S. Cl.
CPC ..... *H01F 1/057* (2013.01); *C22C 38/002* (2013.01); *C22C 38/005* (2013.01); *C22C 38/10* (2013.01);
(Continued)

(58) Field of Classification Search
CPC ..... H01F 1/054; H01F 1/0551; H01F 1/0555; H01F 1/057; H01F 1/0571; H01F 1/0575;
(Continued)

(56) References Cited

U.S. PATENT DOCUMENTS 5,123,979 A 6/1992 Tenaud et al.
5,147,447 A 9/1992 Takeshita et al.
(Continued)

FOREIGN PATENT DOCUMENTS

CN 101640087 A 2/2010
JP 61-264133 11/1986
(Continued)

*Primary Examiner* — Jessee Roe
*Assistant Examiner* — Anthony Liang
(74) *Attorney, Agent, or Firm* — Finnegan, Henderson, Farabow, Garrett & Dunner, LLP

(57) ABSTRACT

A method for producing a nanocrystalline rare earth magnet having a grain and a grain boundary phase includes: quenching a melt of a rare earth magnet composition to form a quenched thin ribbon having a nanocrystalline structure; sintering the quenched thin ribbon to obtain a sintered body; heat treating the sintered body at a temperature which is higher than a lowest temperature in a first temperature range where the grain boundary phase diffuses or flows, and which is lower than a lowest temperature in a second temperature range where the grain becomes coarse; and quenching the heat treated sintered body to 200° C. or less at a cooling speed of 50° C./min or more.

8 Claims, 4 Drawing Sheets

(51) Int. Cl.
*C22C 38/10* (2006.01)
*H01F 41/02* (2006.01)

(52) U.S. Cl.
CPC ..... *H01F 1/0577* (2013.01); *H01F 41/0293* (2013.01); *B22F 2998/10* (2013.01); *C21D 2201/03* (2013.01); *C22C 2202/02* (2013.01); *H01F 1/0579* (2013.01)

(58) Field of Classification Search
CPC ..... H01F 1/0577; H01F 41/0293; C22C 2202/02; C22C 38/005; C22C 38/10; B22F 2009/048; B22F 2003/248
See application file for complete search history.

(56) References Cited

U.S. PATENT DOCUMENTS

| | | | | |
|---|---|---|---|---|
| 5,292,380 | A | 3/1994 | Tanigawa et al. | |
| 6,447,621 | B1 * | 9/2002 | Tokoro ..... | H01F 1/0577 148/302 |
| 2010/0003156 | A1 | 1/2010 | Suzuki et al. | |
| 2010/0321139 | A1 | 12/2010 | Shoji et al. | |
| 2012/0247624 | A1 | 10/2012 | Sakuma et al. | |

FOREIGN PATENT DOCUMENTS

| | | |
|---|---|---|
| JP | 64-72502 | 3/1989 |
| JP | 3-20001 | 1/1991 |
| JP | 6-207203 | 7/1994 |
| JP | 6-207204 | 7/1994 |
| JP | 10-289813 | 10/1998 |
| JP | 2011-3662 | 1/2011 |
| JP | 2011-129768 | 6/2011 |
| WO | WO 2011/073797 A1 | 6/2011 |

* cited by examiner

METHOD FOR PRODUCING RARE EARTH MAGNETS, AND RARE EARTH MAGNETS

CROSS-REFERENCE TO RELATED APPLICATIONS

This application is a national phase application of International Application No. PCT/IB2012/001613, filed Aug. 22, 2012, and claims the priority of Japanese Application No. 2011-181715, filed Aug. 23, 2011, the content of both of which is incorporated herein by reference.

BACKGROUND OF THE INVENTION

1. Field of the Invention

The present invention relates to a method for producing rare earth magnets as typified by neodymium magnets, in more detail, a method for producing nanocrystalline rare earth magnets having grains and grain boundary phases. Further, the present invention relates to nanocrystalline rare earth magnets having grains and grain boundary phases.

2. Description of Related Art

Rare earth magnets as typified by neodymium magnets ($Nd_2Fe_{14}B$) have been variously used as a very strong permanent magnet that is very high in magnetic flux density. In order to further improve the coercive force of the rare earth magnets, a grain is formed into a single domain particle having nano size (several tens to several hundreds nanometers).

Now, it is known that, in general sintered magnets (grain size of several micrometers or more), a heat treatment is applied after sintering to enhance the coercive force. In Japanese Patent Application Publication Nos. 6-207203 and 6-207204, for example, it is confirmed that when an aging heat treatment is applied to NdFeCoBGa system sintered magnets at a temperature equal to or less than the sintering temperature, the coercive force can be improved.

However, it was unknown whether the aging heat treatment is effective or not in magnets of which grains are formed into nano size. That is, while it is considered that the miniaturization of structure largely contributes in improvement of the coercive force, the heat treatment has a risk of making the grain size coarse. Accordingly, the aging heat treatment has not been applied on magnets in which grains have nano size.

In nanocrystalline rare earth magnets, it is very desirable to improve the coercive force. Accordingly, it has been strongly desired to establish an optimum method for improving the coercive force.

SUMMARY OF THE INVENTION

The present invention provides a method for producing rare earth magnets typical in neodymium magnets ($Nd_2Fe_{14}B$), which uses the heat treatment to enhance the magnetic characteristics, in particular, the coercive force. In addition, the present invention provides novel nanocrystalline rare earth magnets having grains and grain boundary phases.

A first aspect of the present invention relates to a method for producing nanocrystalline rare earth magnets having grains and grain boundary phases. The production method includes: quenching a melt of a rare earth magnet composition to form a quenched thin ribbon having a nanocrystalline structure; sintering the quenched thin ribbon to obtain a sintered body; heat treating the sintered body at a temperature which is higher than a lowest temperature in a first temperature range where the grain boundary phase diffuses or flows, and which is lower than a lowest temperature in a second temperature range where the grain becomes coarse; and cooling the heat treated sintered body to a temperature equal to or less than 200° C. at a cooling speed of 50° C./min or more.

Further, a second aspect of the present invention relates to nanocrystalline rare earth magnets represented by the following composition formula.

$$R_vFe_wCo_xB_yM_z,$$

wherein R is one or more kinds of rare earth elements including Y,

M is at least one kind selected from Ga, Zn, Si, Al, Nb, Zr, Ni, Cu, Cr, Hf, Mo, P, C, Mg, V, Hg, Ag and Au, $13 \le v \le 20$, $w = 100 - v - x - y - z$, $0 \le x \le 30$, $4 \le y \le 20$, and $0 \le z \le 3$, wherein the nanocrystalline rare earth magnet is constituted of either one of the following (i) and (ii):

(i) a main phase $R_2(FeCo)_{14}B$, and grain boundary phases $R(FeCo)_4B_4$ and R, and (ii) a main phase $R_2(FeCo)_{14}B$, and grain boundary phases $R_2(FeCo)_{17}$ and R, wherein the minimum value of an atomic ratio of Fe to Nd (Fe/Nd) in a grain boundary phase when analyzed by energy dispersive X-ray spectrometry is 1.00 or less.

According to the production method of the present invention, the sintered body is heat treated at a temperature which is higher than a lowest temperature in a first temperature range where the grain boundary phase diffuses or flows, and which is lower than a lowest temperature in a second temperature range where the grain becomes coarse. Thereby, a grain boundary phase that is eccentrically located at a triple point, that is, a grain boundary phase that is eccentrically located in a space formed between grains at a place where three or more grains come into contact each other is supplied over an entire grain boundary to allow for the grain boundary phase to cover main phase grains of nano size. Thereby, the exchange coupling between main phases is decoupled to increase the coercive force of the rare earth magnet. According to the production method of the present invention, by quenching the sintered body that was thus heat treated to a temperature of 200° C. or less at a cooling speed of 50° C./min or more, the coercive force of the rare earth magnet can be made particularly large.

According to nanocrystalline rare earth magnet of the present invention, the minimum value of an atomic ratio of Fe to Nd (Fe/Nd) in a grain boundary phase when analyzed by energy-dispersive X-ray spectrometry is 1.00 or less, that is, the content of Fe in the grain boundary phase is small. As a result, a large coercive force can be provided.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 5A is a diagram when the cooling speed is 2° C./min, and FIG. 5B is a diagram when the cooling speed is 163° C./min.

DETAILED DESCRIPTION OF EMBODIMENTS

<Composition>

A rare earth magnet produced according to a production method of the present invention and a rare earth magnet according to an embodiment of the present invention can have a composition shown below, for example.

$$R_vFe_wCo_xB_yM_z,$$

wherein R is one or more kinds of rare earth elements including Y,

M is at least one kind selected from Ga, Zn, Si, Al, Nb, Zr, Ni, Cu, Cr, Hf, Mo, P, C, Mg, V, Hg, Ag and Au, $13 \leq v \leq 20$, for example $13 \leq v \leq 17$, $w=100-v-x-y-z$, $0 \leq x \leq 30$, $4 \leq y \leq 20$, for example $5 \leq y \leq 16$, and $0 \leq z \leq 3$.

The nanocrystalline rare earth magnet may be constituted of either one of the following (i) and (ii):

(i) a main phase $R_2(FeCo)_{14}B$, and grain boundary phases $R(FeCo)_4B_4$ and R, and (ii) a main phase $R_2(FeCo)_{14}B$, and grain boundary phases $R_2(FeCo)_{17}$ and R, wherein, M may contain an additive element that forms an alloy with R to decrease the lowest temperature in a temperature range where the grain boundary phase diffuses or flows, and the additive element may be added to a rare earth magnet composition at an amount in the range that can develop the temperature decrease effect and does not deteriorate the magnetic characteristics and the hot workability.

<Nanocrystalline Structure>

According to a production method of the present invention, a melt having a rare earth magnet composition is quenched to form a quenched thin ribbon having a structure made of nanocrystals (nanocrystalline structure). Here, the nanocrystalline structure is a polycrystalline structure of which grains have a nano size. The nano size means a size smaller than a size of a single magnetic domain, about 10 to 300 nm, for example.

The quenching speed is in a range appropriate for a solidified structure to form a nanocrystalline structure. When the quenching speed is slower than that of the range, the solidified structure becomes a coarse crystalline structure, that is, a nanocrystalline structure can not be obtained. When the quenching speed is faster than that of the range, the solidified structure becomes amorphous, and a nanocrystalline structure can not be obtained.

Figure 1:
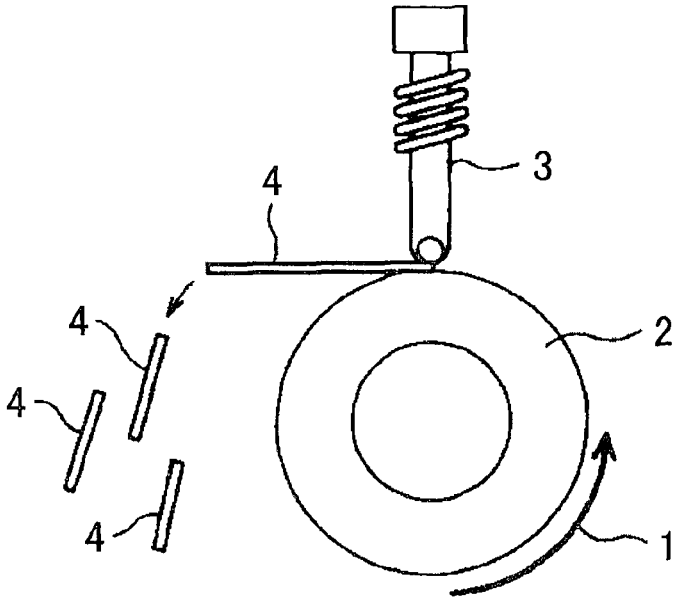
FIG. 1 schematically shows a method for producing a quenched thin ribbon according to a single roll method.

A method for quenching and solidifying is not particularly restricted. However, desirably, a single roll furnace illustrated in FIG. 1 is used. On an outer peripheral surface of a single roll 2 that rotates in a direction of arrow 1, an alloy melt is sprayed from a nozzle 3 to rapidly cool and solidify to form thin ribbons 4. According to a single roll method, by unidirectional solidification that directs toward a free surface of a thin ribbon from a surface of the thin ribbon in contact with a roll outer peripheral surface, quenched thin ribbons are solidified and formed, as a result, on a free surface of the thin ribbon (finally solidifying portion: portion that solidifies at the end), a low melting phase is formed. The low melting phase on a surface of the thin ribbon causes a sintering reaction at a low temperature in the sintering step. That is, the single roll method is very advantageous for the low temperature sintering.

Compared with this, according to a twin-roll method, solidification that directs from both surfaces of the thin ribbon to a center thereof is caused. As a result, a low melting phase is formed not on a surface of the thin ribbon but in the center thereof. Accordingly, in the twin roll method, the low temperature sintering effect like in the single roll method can not be obtained.

In general, when the quenching process is conducted to form a nanocrystalline structure while avoiding generation of a coarse crystalline structure, the quenching speed tends to be higher than an upper limit of an appropriate range. Individual quenched thin ribbon may be either in a nanocrystalline structure or in an amorphous structure. In this case, quenched thin ribbons having a nanocrystalline structure have to be selected from a mixture of quenched thin ribbons having different structures.

Figure 2:
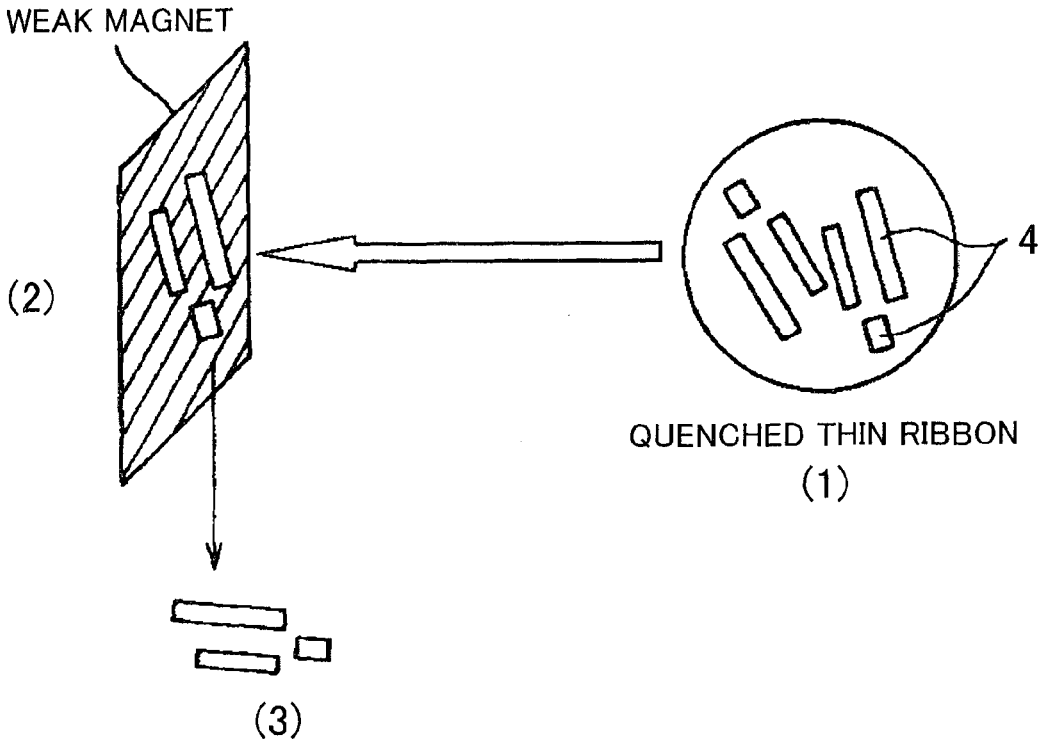
FIG. 2 schematically shows a method for fractionating a quenched thin ribbon into an amorphous thin ribbon or a crystalline thin ribbon.

Therefore, as illustrated in FIG. 2, a weak magnet is used to fractionate the quenched thin ribbons into crystalline thin ribbons and amorphous thin ribbons. In other words, among the quenched thin ribbons (1), while amorphous thin ribbons are magnetized with a weak magnet and do not fall (2), crystalline thin ribbons are not magnetized and fall (3).

<Sintering>

According to a production method of the present invention, generated and, as required, fractionated quenched thin ribbons having a nanocrystalline structure are sintered. A method for sintering is not particularly restricted. However, it is necessary to conduct the sintering at a temperature as low as possible and for a time as short as possible not so as to make the nanocrystalline structure coarse. Accordingly, it is preferable to conduct sintering under pressure. When the sintering is conducted under pressure, since the sintering reaction is accelerated, low temperature sintering is made possible, and the nanocrystalline structure can be maintained.

In order to prevent grains of the sintered structure from becoming coarse, also the temperature increase speed to the sintering temperature is desirable to be fast.

From these viewpoints, the sintering by energizing and heating under pressure, for example, commonly known "SPS" (Spark Plasma Sintering) is desirable. According to the method, when the energization is promoted by pressurization, the sintering temperature can be lowered and a short time period is necessary to reach the sintering temperature. Accordingly, the nanocrystalline structure can be most advantageously maintained.

However, without restricting to the SPS sintering, also hot pressing can be used.

In addition, as a method similar to the hot pressing, a method where an ordinary press molding machine is used in combination with high frequency heating and heating by an auxiliary heater can be used. In the high frequency heating, a work is directly heated by using an insulating dies/punch, or a dies/punch is heated by using a conductive dies/punch and a work is indirectly heated by the heated dies/punch. In the heating by auxiliary heater, the dies/punch is heated by a cartridge heater, a hand heater and so on.

<Alignment Treatment>

According to the production method of this embodiment, an alignment treatment can be optionally applied to the resulted sintered body. A typical method of alignment treatment is the hot working. Particularly, severe plastic deformation where the degree of processing, that is, a magnitude of deformation of the thickness of the sintered body is 30% or more, 40% or more, 50% or more or 60% or more is desirable.

When a sintered body is hot worked (rolled, forged, or extruded), in conjunction with the slip deformation, grain itself and/or a crystal direction in grain rotates to align a direction of an axis of easy magnetization (c axis in the case of hexagonal crystal) (anisotropization). When the sintered body is formed into a nanocrystalline structure, grain itself and/or a crystal direction in grain readily rotates to promote alignment. As a result, a microaggregate structure in which nano size grains are highly aligned is obtained, and, an anisotropic rare earth magnet, in which while securing high coercive force the residual magnetization is remarkably improved, can be obtained. Further, a homogeneous crystalline structure made of nano size grains enables to obtain also excellent squareness.

However, a method for alignment treatment is not restricted to the hot working. A method for alignment treatment may be a method that can align while maintaining the nano size of the nanocrystalline structure. For example, a method where anisotropic powder (powder treated by Hydrogenation-Disproportionation-Desorption-Recombination (HDDR)) is compacted in a magnetic field and solidified, and thereafter pressure sintering is applied can be cited.

<Heat Treatment>

According to the production method of this embodiment, after sintering, or after sintering and optional alignment treatment, heat treatment is applied. According to the heat treatment, a grain boundary phase that is eccentrically located primarily at a triple point of a grain boundary is diffused or flowed over an entire grain boundary.

When a grain boundary phase is eccentrically located at the triple point, a place where a grain boundary phase is not present between adjacent main phases is present (or a place where abundance thereof is insufficient is present). Accordingly, in a place like this, an exchange coupling interaction works across a plurality of main phases, and an effective main phase size becomes coarse to deteriorate the coercive force. When the abundance of the grain boundary phase is sufficient between adjacent main phases, since the exchange coupling between adjacent main phases is decoupled and an effective size of the main phase is miniaturized, high coercive force can be obtained.

Now, a heat treatment temperature is a temperature which is higher than the lowest temperature in a temperature range (which can be regarded as a first temperature range) where diffusion and flow of a grain boundary phase is realized, and which is lower than the lowest temperature in a temperature range (which can be regarded as a second temperature range) where a grain becomes coarse.

As an index of a temperature which is the lowest temperature in a temperature range wherein a grain boundary phase diffuses or flows, typically, the melting temperature of a grain boundary phase can be cited. Accordingly, for example, the lower limit of the heat treatment temperature can be set to a temperature higher than the melting temperature or the eutectic temperature of the grain boundary phase.

As shown below, the melting temperature of a grain boundary phase can be decreased by adding an additive element. For example, specifically, in a neodymium magnet, the lower limit of the heat treatment temperature can be set to a temperature in the melting temperature or the eutectic temperature of Nd—Cu phase or the proximity of the melting temperature or the eutectic temperature of Nd—Cu phase. The lower limit of the heat treatment temperature is a temperature of, for example, 450° C. or more.

As an indicator of a temperature that prevents grains from becoming coarse, a temperature that prevents a main phase, for example, a $Nd_2Fe_{14}B$ phase in the neodymium magnet from becoming coarse can be cited. Accordingly, for example, the upper limit of the heat treatment temperature can be set to the lowest temperature in a temperature range where a grain size after heat treatment becomes 300 nm or less, 250 nm or less, or 200 nm or less. For example, the temperature is 700° C. or less. In the present embodiment, the grain size means a projected area-equivalent diameter, that is, a diameter of a circle that has an area the same as the projected area of the particle.

Further, a time for heat treatment can be set to 1 min or more, 3 min or more, 5 min or more, or 10 min or more, and 30 min or less, 1 hr or less, 3 hr or less or 5 hr or less. Here, even when the holding time is a relatively short time, for example, about 5 min, the coercive force can be improved.

Figure 3A:
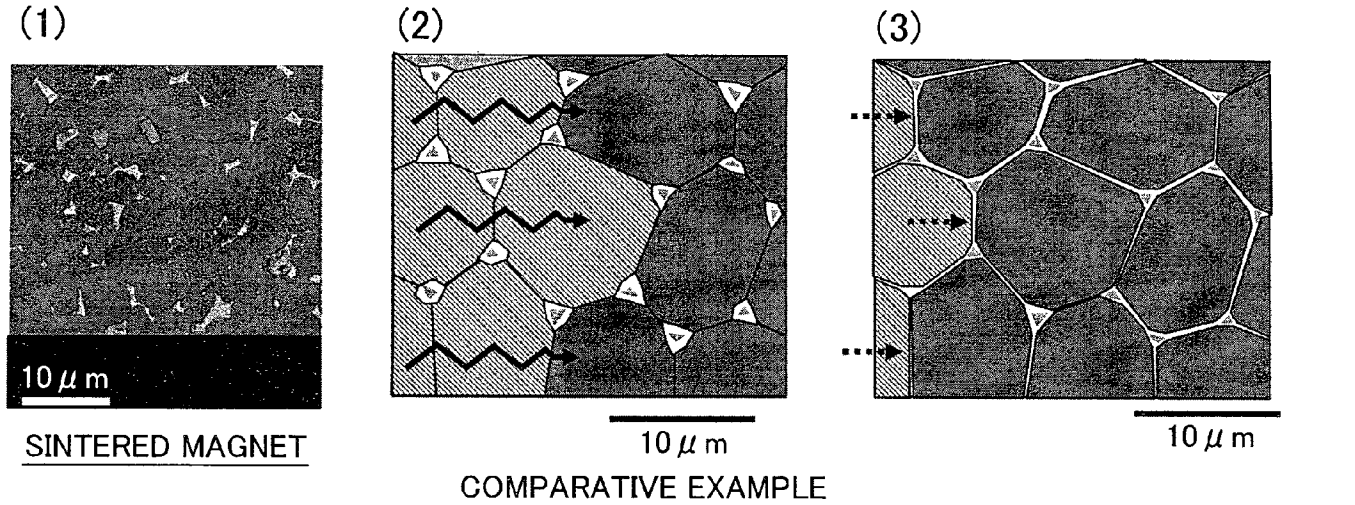
FIGS. 3A and 3B, respectively, schematically show by comparison a shape change (movement) of a grain boundary phase caused by heat treatment of a sintered rare earth magnet of comparative example and a nanocrystalline rare earth magnet of an embodiment of the present invention. In each of FIGS. 3A and 3B, (1) a structural photograph before heat treatment, (2) and (2') structural image diagrams before heat treatment, and (3) and (3') structural image diagrams after heat treatment are shown.
Figure 3B:
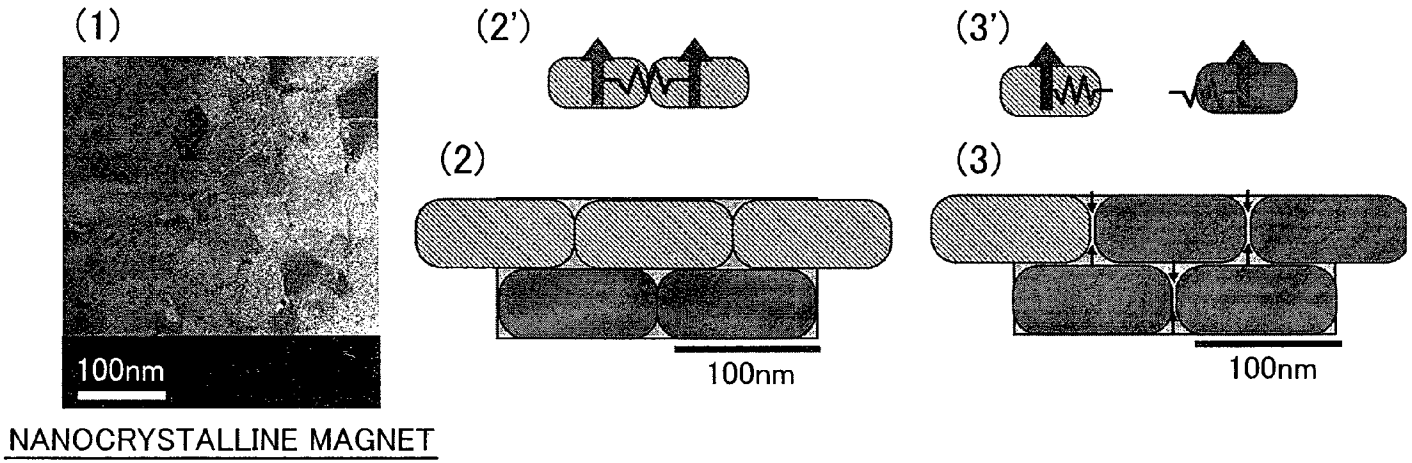

With reference to FIGS. 3A and 3B, advantage of the heat treatment will be described.

FIGS. 3A and 3B, respectively show (1) a structural photograph before the heat treatment, (2) and (2') a structural image diagram before the heat treatment, and (3) and (3') a structural image diagram after heat treatment of a sintered rare earth magnet of comparative example and a nanocrystalline rare earth magnet of the present embodiment. Here, in structural image diagrams before and after the heat treatment, hatched grains and gray grains are opposite in a magnetization direction.

In the case of the sintered rare earth magnet of comparative example (FIG. 3A), a size of grains is typically about 10 μm. This is far larger than about 300 nm (0.3 μm) that is a size of a single magnetic domain; accordingly, magnetic walls are present inside a grain. As a result, a state of magnetization varies depending on a movement of magnetic walls.

In the case of the sintered rare earth magnet of comparative example (FIG. 3A), before the heat treatment (2), a grain boundary phase is eccentrically located at a triple point of a grain boundary but is not present or very slight in a grain boundary other than the triple point. Since the grain boundary does not work as a barrier against a movement of the magnetic wall and a magnetic wall moves across the grain boundary to reach adjacent grain, high coercive force can not be obtained. On the other hand, after the heat treatment (3), a grain boundary phase diffuses or flows from the triple point to sufficiently permeate into a grain boundary other than the triple point to cover grains. In this case, a grain boundary phase abundantly present in the grain boundary blocks a movement of a magnetic wall and thereby the coercive force is improved.

On the other hand, in the case of nanocrystalline rare earth magnet (FIG. 3B) of the present embodiment, a grain size is typically about 100 nm (0.1 μm) and a grain is a single magnetic domain; accordingly, a magnetic wall is not present.

In the case of a nanocrystalline rare earth magnet of the present embodiment (FIG. 3B), before the heat treatment (2), a grain boundary phase is eccentrically localized at a triple point of a grain boundary but is not present or slightly present in a grain boundary other than the triple point. As the result, since a grain boundary does not function as a barrier against the exchange coupling between adjacent grains and adjacent grains are integrated with each other by the exchange coupling (2'), the magnetization reversal induces magnetization reversal of adjacent grains, and, high coercive force can not be obtained. On the other hand, after the heat treatment (3), a grain boundary phase diffuses and flows from the triple point and sufficiently permeates into grain boundaries other than the triple point to cover grains. In this case, since a grain boundary phase present abundantly in a grain boundary decouples (3') the exchange coupling between adjacent grains, the coercive force is improved.

Further, in the case of the nanocrystalline rare earth magnet of the present embodiment (FIG. 3B), the rare earth magnet has a nanocrystalline structure and a grain size is very small. As a result, a grain boundary phase diffused or flowed from the triple point covers grains in a very short time. As the result, a heat treatment time can be largely shortened.

<Quenching Process>

According to the production method of this embodiment, a heat treated sintered body is quenched to a temperature of 300° C. or less, 200° C. or less, 100° C. or less or 50° C. or less at the cooling speed of 50° C./min or more, 80° C./min or more, 100° C./min or more, 120° C./min or more or 150° C./min or more.

When thus quenched, the coercive force of the resulted rare earth magnet can be made remarkably large. Though not restricted by a theory, according to the quenching like this, it is considered that, in a sintered body after the heat treatment, Fe present in a main phase grain boundary is inhibited from diffusing into a grain boundary phase, thereby a content of Fe in the main grain boundary phase becomes low and the exchange coupling between adjacent grains (main phase) is prevented to result in large coercive force of the resulted magnet.

A temperature range to be passed rapidly by quenching is a temperature where Fe present on a main phase grain boundary diffuses. Accordingly, the quenching is necessary to be conducted to a temperature of 200° C. or less. Herein, a cooling temperature to be achieved by the quenching is considered to depend on composition, and grain size of the magnet.

<Additive Element>

It is preferable to add an element that decreases the melting temperature of a grain boundary phase to a rare earth magnet composition. According to the production method of this embodiment, by thus adding an element to decrease the melting temperature of a grain boundary phase, the heat treatment can be applied at a low temperature. That is, while inhibiting grains from becoming coarse, a grain boundary phase that is eccentrically located mainly at the triple point of a grain boundary can be diffused or flowed to an entirety of the grain boundary.

Examples of elements that decrease the lowest temperature in a temperature range where a grain boundary phase diffuses or flows, in particular, elements that form an alloy with Nd that constitutes the rare earth magnet include Al, Cu, Mg, Hg, Fe, Co, Ag, Ni, and Zn, in particular, Al, Cu, Mg, Fe, Co, Ag, Ni and Zn. An addition amount of these additive elements can be set to 0.05 to 0.5 atomic percent and more preferably to 0.05 to 0.2 atomic percent.

As a typical example, when the rare earth magnet composition is represented by the formula $R_vFe_wCo_xB_yM_z$ and a grain boundary phase abundant in Nd is formed, for example, when the rare earth magnet composition is represented by the formula $Nd_{15}Fe_{77}B_7Ga$ and the rare earth magnet contains a main phase made of $Nd_2Fe_{14}B$ and a grain boundary phase abundant in Nd, an element that forms an alloy with Nd to allow to decrease the lowest temperature in a temperature range where the diffusion or flow of a grain boundary phase is realized can be added to the rare earth magnet composition in particular as the element M by an amount in a range where the temperature decrease effect is developed and the magnetic characteristics and the hot workability are not deteriorated.

For reference, eutectic temperatures (melting temperatures of eutectic compositions) of binary alloys between the additive elements and Nd are shown below compared with the melting temperature of Nd simple body. As mentioned above, the melting temperature or eutectic temperature is an index of the lowest temperature in a temperature range where a grain boundary phase diffuses or flows.

Nd: 1024° C. (melting temperature)

Nd—Al: 635° C. (melting temperatures of eutectic compositions)

Nd—Cu: 520° C. (melting temperatures of eutectic compositions)

Nd—Mg: 551° C. (melting temperatures of eutectic compositions)

Nd—Fe: 640° C. (melting temperatures of eutectic compositions)

Nd—Co: 566° C. (melting temperatures of eutectic compositions)

Nd—Ag: 640° C. (melting temperatures of eutectic compositions)

Nd—Ni: 540° C. (melting temperatures of eutectic compositions)

Nd—Zn: 630° C. (melting temperatures of eutectic compositions)

<<Nanocrystalline Rare Earth Magnet>>

A nanocrystalline rare earth magnet of the present embodiment is represented by the following formula:

$$R_vFe_wCo_xB_yM_z,$$

(wherein, R: one or more kinds of rare earth elements including Y,

M: at least one kind selected from Ga, Zn, Si, Al, Nb, Zr, Ni, Cu, Cr, Hf, Mo, P, C, Mg, V, Hg, Ag and Au, $13 \le v \le 20$, $w=100-v-x-y-z$, $0 \le x \le 30$, $4 \le y \le 20$, and $0 \le z \le 3$), and is constituted of either one of the following (i) and (ii):

(i) a main phase $R_2(FeCo)_{14}B$, and a grain boundary phase $R(FeCo)_4B_4$ and R, and (ii) a main phase $R_2(FeCo)_{14}B$, and a grain boundary phase $R_2(FeCo)_{17}$ and R, wherein the minimum value of an atomic ratio (Fe/Nd) of Fe to Nd in a grain boundary phase when analyzed by energy dispersive X-ray spectrometry is 1.00 or less, 0.90 or less, 0.80 or less, 0.70 or less, or 0.60 or less.

Regarding a composition and a method for producing the rare earth magnet of the present embodiment, the description of the method of the present embodiment for producing a rare earth magnet can be referred.

Example 1

A nanocrystalline rare earth magnet having a composition of $Nd_{15}Fe_{77}B_7Ga_1$ was produced. A finally obtained composition is a nanocrystalline structure including a $Nd_2Fe_{14}B_1$ as a main phase and a Nd-rich phase (Nd or Nd oxide) or a $Nd_1Fe_4B_4$ phase as a grain boundary phase. Ga is enriched in a grain boundary phase to prevent a grain boundary from moving, and grains are suppressed from becoming coarse.

<Preparation of Alloy Ingot>

In order to obtain the above-mentioned composition, respective raw materials of Nd, Fe, B and Ga were measured by predetermined amounts and were melted by an arc melting furnace. Thus, an alloy ingot was prepared.

<Preparation of Quenched Thin Ribbon>

An alloy ingot was melted in a high frequency furnace, and the resulted melt was sprayed on a roll surface of a copper single roll as shown in FIG. 1 and quenched. Conditions used were as shown below.

<<Quenching Condition>>
Nozzle diameter: 0.6 mm
Clearance: 0.7 mm
Spray Pressure: 0.4 kg/cm$^3$
Roll Speed: 2350 rpm
Melting Temperature: 1450° C.

<Fractionation>

In the resulted quenched thin ribbons, as mentioned above, nanocrystalline quenched thin ribbons and amorphous thin ribbons are mingled. Accordingly, as shown in FIG. 2, the nanocrystalline thin ribbons and the amorphous thin ribbons were fractionated with a weak magnet. In other words, as shown in FIG. 2, among the quenched thin ribbons (1), the amorphous thin ribbon, which is a soft magnetic material, was magnetized with a weak magnet, and did not fall (2). On the other hand, the nanocrystalline quenched thin ribbon, which is a hard magnetic body, was not magnetized with a weak magnet and fell (3). Fallen nanocrystalline quenched thin ribbons alone were gathered and subjected to the following treatment.

<Sintering>

The resulted nanocrystalline quenched thin ribbons were SPS sintered under the following conditions.

<<Condition of SPS Sintering>>
Sintering temperature: 570° C.
Holding time: 5 min
Atmosphere: $10^{-2}$ Pa (Ar)
Surface pressure: 100 MPa As described above, surface pressure of 100 MPa was applied during sintering. This is surface pressure exceeding initial surface pressure 34 MPa for securing energization, and thereby, under condition of sintering temperature of 570° C. and holding time of 5 min, the sintered density of 98% (=7.5 g/cm3) was obtained. In order to obtain the sintered density the same as that mentioned above, while a high temperature of about 1100° C. was necessary when pressure is not applied, the sintering temperature could be largely decreased.

Further, the low temperature sintering was realized, partly because a low melting temperature phase is formed on one surface of a quenched thin ribbon by a single roll method. As specific examples of the melting temperature, while the melting temperature of main phase $Nd_2Fe_{14}B_1$ is 1150° C., the melting temperature of the low melting temperature phase is 1021° C. for Nd and 786° C. for $Nd_3Ga$, for example.

That is, in the present embodiment, an effect of the sintering temperature decrease due to pressurization itself of the pressure sintering (surface pressure: 1000 MPa), and an effect of the sintering temperature decrease due to a low melting temperature phase present on one surface of the quenched thin ribbon were combined. Thereby, the sintering temperature of the 570° C. could be obtained.

<Hot Working>

As the alignment treatment, hot working was applied with an SPS device under the following severe plastic deformation condition.

<<(Hot Working Condition>>
Processing temperature: 650° C.
Processing pressure: 100 MPa
Atmosphere: $10^{-2}$ Pa (Ar)
Degree of processing: 60%

<Heat Treatment>

The resulted severely plastically deformed body was cut into 2 mm squares and the squares were heat treated under the following condition.

<<Heat Treatment Condition>>
Holding temperature: 550° C.
Temperature increase speed from room temperature to the holding temperature: 120° C./min (constant)
Holding time: 30 min (constant)
Cooling: 2° C./min to 2,200° C./min
Atmosphere: 2 Pa (Ar)

<Evaluation of Magnetic Property>

The magnetic characteristics before and after the heat treatment were measured of the resulted sample (composition: $Nd_{15}Fe_{77}B_7Ga_1$) with VSM. Results are shown in Table 1 and FIG. 4.

TABLE 1

Cooling Speed Dependence of Coercive Force

| | Cooling speed (° C./min) | | | | | |
|---|---|---|---|---|---|---|
| | 2200 | 163 | 50 | 20 | 10 | 2 |
| Hc (kOe) before heat treatment | 17.727 | 17.451 | 17.662 | 18.091 | 17.539 | 16.95 |
| Hc (kOe) after heat treatment | 18.144 | 18.079 | 17.798 | 18.02 | 17.462 | 16.094 |
| Change of coercive force (%) | 2.35 | 3.60 | 0.77 | −0.39 | −0.44 | −5.05 |

Figure 4:
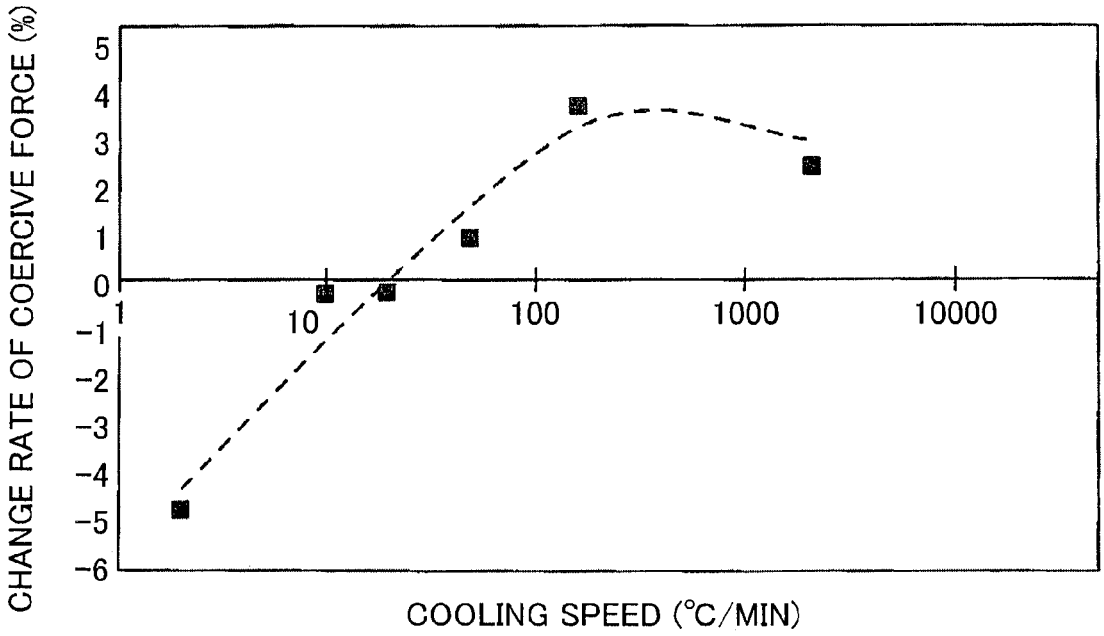
FIG. 4 is a diagram showing relationship between the cooling speeds after the heat treatment and the coercive forces of resulted nanocrystalline rare earth magnets.

From results of Table 1 and FIG. 4, it is understood that as the cooling speed after the heat treatment becomes larger, the coercive force of the resulted nanocrystalline rare earth magnet becomes larger.

Figure 5A:
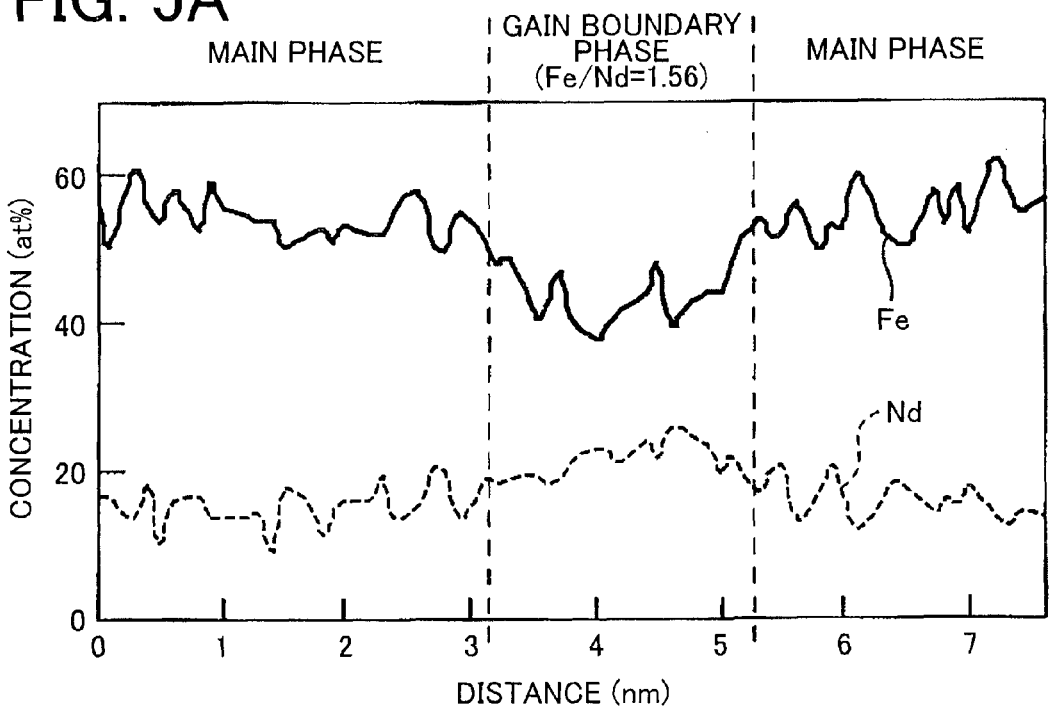
FIGS. 5A and 5B each is a diagram showing composition variation between main phases (grain) and a grain boundary phase when analyzed by energy-dispersive X-ray spectrometry (EDX). Here.
Figure 5B:
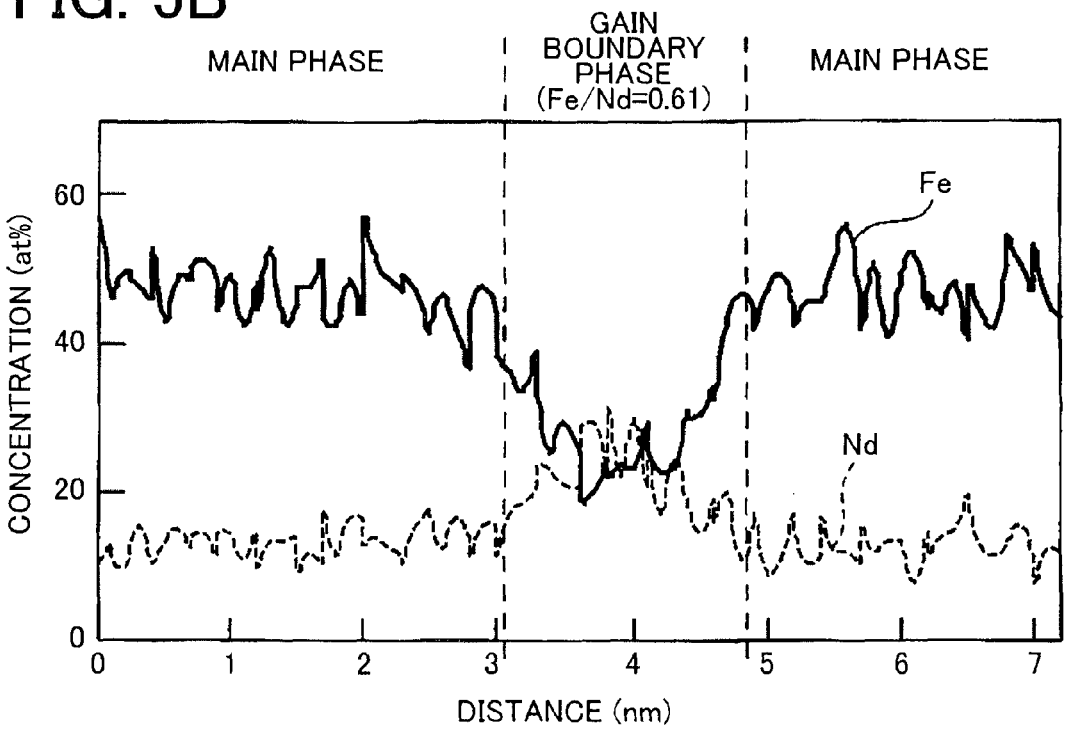

Further, a composition change between a main phase (grain) and a grain boundary phase when analyzed by energy-dispersive X-ray spectrometry (EDX) is shown in FIGS. 5A and 5B. FIG. 5A is a diagram when the cooling speed is 2° C./min, and FIG. 5B is a diagram when the cooling speed is 163° C./min.

From FIGS. 5A and 5B, it is understood that, when the cooling speed is high, a composition between a main phase (grain) and a grain boundary is changed largely in comparison with the case where the cooling speed is slow, in particular, a content rate of Fe in a grain boundary phase becomes smaller.

The invention claimed is:

1. A method of producing a nanocrystalline rare earth magnet having a grain and a grain boundary phase, comprising:

quenching a melt of a rare earth magnet composition to form a quenched thin ribbon having a nanocrystalline structure;

sintering the quenched thin ribbon to obtain a sintered body;

applying an alignment treatment to the sintered body;

after the alignment treatment was applied, heat treating the sintered body at a heat treatment temperature which is higher than a lowest temperature in a first temperature range where the grain boundary phase diffuses or flows, and which is lower than a lowest temperature in a second temperature range where the grain becomes coarse, wherein the heat treatment temperature is 450 to 700° C.; and quenching the heat treated sintered body to 200° C. or less at a cooling speed of 150° C./min or more, wherein the rare earth magnet composition is represented by the following composition formula:

$$R_vFe_wCo_xB_yM_z$$

wherein, R is one or more kinds of rare earth elements including Y,

M is at least one kind of Ga, Zn, Si, Al, Nb, Zr, Ni, Cu, Cr, Hf, Mo, P, C, Mg, V, Hg, Ag and Au, $13 \leq v \leq 20$, $w=100-v-x-y-z$, $0<x \leq 30$, $4 \leq y \leq 20$, and $0 \leq z \leq 3$, wherein the rare earth magnet is constituted of either one of the following (i) and (ii):

(i) a main phase $R_2(FeCo)_{14}B$, and a grain boundary phase $R(FeCo)_4B_4$ and R, and (ii) a main phase $R_2(FeCo)_{14}B$, and a grain boundary phase $R_2(FeCo)_{17}$ and R.

2. The method according to claim 1, wherein the heat treatment temperature is a temperature which is higher than a melting temperature or eutectic temperature of the grain boundary phase, and which is in a third temperature range where a grain size after the sintered body is heat treated is 300 nm or less.

3. The method according to claim 1, wherein a holding time while the sintered body is heat treated is in the range of 1 min to 5 hr.

4. The method according to claim 1, wherein an additive element that decreases the lowest temperature in the first temperature range where the grain boundary phase diffuses or flows is added to the rare earth magnet composition.

5. The method according to claim 4, wherein the rare earth magnet contains Nd, and the additive element is an element that decreases a melting temperature or eutectic temperature of the grain boundary phase to a temperature which is lower than the melting temperature of Nd simple substance.

6. The method according to claim 4, wherein the additive element is selected from Al, Cu, Mg, Fe, Co, Ag, Ni, and Zn.

7. The method according to claim 1, wherein a minimum value of an atomic ratio of Fe to R in the grain boundary phase when analyzed by energy dispersive X-ray spectrometry is 1.00 or less.

8. The method according to claim 1, wherein the rare earth magnet is constituted of either one of the following (i) and (ii):

(i) a main phase $Nd_2Fe_{14}B$, and a grain boundary phase $R(FeCo)_4B_4$ and R, and (ii) a main phase $Nd_2Fe_{14}B$, and a grain boundary phase $R_2(FeCo)_{17}$ and R; and wherein a minimum value of an atomic ratio of Fe to Nd in the grain boundary phase when analyzed by energy dispersive X-ray spectrometry is 1.00 or less.

* * * * *